United States Patent [19]

Myeeo

[11] Patent Number: 4,832,303

[45] Date of Patent: May 23, 1989

[54] READING MATERIAL SUPPORT STAND

[76] Inventor: Billy Myeeo, 3765 Tamarack La. #86, Santa Clara, Calif. 95051

[21] Appl. No.: 169,996

[22] Filed: Mar. 18, 1988

[51] Int. Cl.[4] ..... A47B 23/00

[52] U.S. Cl. ..... 248/444.1; 248/464; 248/460

[58] Field of Search ..... 248/441.1, 444.1, 447, 248/462, 463, 464, 465, 163.1, 165, 166, 439, 445, 460, 188.5, 188.6; 40/610, 124, 341, 352

[56] References Cited

U.S. PATENT DOCUMENTS

| | | | |
|---|---|---|---|
| 1,083,764 | 1/1914 | Smith | 248/444.1 |
| 1,444,569 | 2/1923 | Starkweather | 248/188.5 |
| 2,448,734 | 9/1948 | Phillips | 248/444.1 |
| 2,546,283 | 3/1951 | Webster | 248/444.1 |
| 2,638,300 | 5/1953 | De Jen | 248/464 |
| 2,844,347 | 7/1958 | Henry | 248/460 |
| 3,476,348 | 11/1969 | Rustad | 248/451 |
| 3,567,166 | 3/1971 | Grawdjean | 248/188.6 |
| 4,313,589 | 2/1982 | Vega | 248/460 |
| 4,465,255 | 8/1984 | Hill | 248/445 |
| 4,596,372 | 6/1986 | Ford | 248/444.1 |
| 4,718,630 | 1/1988 | Richard | 248/444.1 |

FOREIGN PATENT DOCUMENTS

| | | | |
|---|---|---|---|
| 2577302 | 8/1986 | France | 248/188.5 |
| 192233 | 2/1923 | United Kingdom | 248/441.1 |
| 427291 | 4/1935 | United Kingdom | 248/463 |
| 1478012 | 6/1977 | United Kingdom | 248/444.1 |

*Primary Examiner*—J. Franklin Foss
*Assistant Examiner*—Robert A. Olson
*Attorney, Agent, or Firm*—Leon Gilden

[57] ABSTRACT

A reading material support stand is set forth wherein the same is formed of a collapsible interfoldable organization wherein a transparent foldable support surface is generally inclined at an acute angle of approximately 70 degrees to enable a reclining reader to avail himself of reading material positioned on the opposite side of said support surface. The support surface is secured to a foldable framework formed with telescoping legs at peripheral portions of the support surface framework wherein the telescoping legs further include foldable legs latchable into a predetermined orientation relative to the telescoping legs.

9 Claims, 4 Drawing Sheets

READING MATERIAL SUPPORT STAND

BACKGROUND OF THE INVENTION

1. Field of the Invention

The field of the invention relates to support surfaces for reading material and more particularly pertains to a new and improved reading material support stand wherein the same may be interfolded into a compact organization for storage and transport of same.

2. Description of the Prior Art

The use of reading material support stands is known in the prior art. As may be appreciated, these devices have normally been configured for unique orientations and positions with respect to a user thereof. In this regard therefore, they have been of specialized and unique constructions thereby limiting their versatility and application to a variety of situations. For example, U.S. Pat. No. 1,083,764 to Smith illustrates the use of a "U" shaped support bracket securing thereto a transparent sheet pivotally mounted in a yoke to orient reading material positioned in the reverse side thereof to a reader reclining particularly as in a bed. While an interesting organization relating to a particular and specialized application, the Smith patent lacks the function and structure available in the instant invention to accommodate a variety of reader orientations and positions relative to reading material.

U.S. Pat. No. 2,448,734 to Phillips illustrates an additional bed supported book holder wherein a clamp-like arrangement secures a transparent sheet to a headboard of an associated bed and wherein an overlying transparent sheet supportingly secures a book or the like relative to a reader lying in said bed. As in the Smith patent, the Phillips patent provides a unique structural arrangement specific to a reader within a bed and is of a relatively remote organization to the instant invention.

U.S. Pat. No. 2,546,283 to Webster illustrates the use of a foldable transparent one-piece planar support surface for positionally securing reading material thereon wherein said organization may be positioned on a bed to enable an individual lying therein to avail himself of the reading material. The Webster organization is of interest in the manner it solves a particular problem but is generally adaptable only to the bedside orientation of the organization and is not generally applicable to a variety of reading environments as the instant invention is capable of.

U.S. Pat. No. 3,476,348 to Rustad illustrates an additional solid transparent one-piece sheet wherein a collapsible "J" shaped leg organization is pivotal to an orientation generally orthogonal to said sheet to enable positioning on a bed surface to enable a reader thereof to avail himself of reading material overlying the transparent sheet.

U.S. Pat. No. 4,465,255 to Hill illustrates a relatively complex bracketry arrangement to enable positioning of a general "U" shaped leg to a sandwiched orientation between mattresses of a bed to supportingly secure a transparent sheet that may clampingly secure reading material thereon to enable individuals lying in the associated bed to read without the use of their limbs for securement of the reading material.

U.S. Pat. No. 4,596,372 to Ford illustrates a floor mounted clamp wherein an overlying yoke pivotally secures reading material wherein a cantilever arrangement enables the height and angularity of the support sheet to be varied.

As such, it may be appreciated that there is continuing need for a new and improved reading material support stand which addresses both the problem of storage, portability, and effectiveness, and in this respect the present invention substantially fulfills this need.

SUMMARY OF THE INVENTION

In view of the foregoing disadvantages inherent in the known types of reading material support stands now present in the prior art, the present invention provides an reading material support stand wherein the same may be compactly stored when not in use and can further be easily and efficiently unfolded and extended to provide a reading material support stand relative to a user at a variety of orientations and heights relative to the support stand. As such, the general purpose of the present invention, which will be described subsequently in greater detail, is to provide a new and improved reading material support stand which has all the advantages of the prior art reading material support stands and none of the disadvantages.

To attain this, the present invention comprises a reading material support stand which may be compactly folded in half and provided with telescoping legs which may be retracted to provide a compact easily storable and transported organization. A foldable transparent support surface is provided with side rails guidingly accepting extensible and retractable legs provided with pivotal feet lockable into a support position. Accordingly, the height of support stand may be varied to enable a reader to utilize the stand either in a reclined or seated position.

The invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved reading material support stand which has all the advantages of the prior art reading material support stands and none of the disadvantages.

It is another object of the present invention to provide a new and improved reading material support stand which may be easily and efficiently manufactured and marketed.

It is a further object of the present invention to provide a new and improved reading material support stand which is of a durable and reliable construction.

An even further object of the present invention is to provide a new and improved reading material support stand which is susceptible of a low cost of manufacture with regard to both materials and labor, and which accordingly is then susceptible of low prices of sale to the consuming public, thereby making such reading material support stand economically available to the buying public.

Still yet another object of the present invention is to provide a new and improved reading material support stand which provides in the apparatuses and methods of the prior art some of the advantages thereof, while simultaneously overcoming some of the disadvantages normally associated therewith.

Still another object of the present invention is to provide a new and improved reading material support stand which may be compactly folded in half and is provided with frame-like side rails telescopingly accepting extensible and retractable legs provided with locking feet to orient the associated support stand at an angle of approximately 70 degrees to accommodate users to avail themselves of reading material both lying down and in a seated orientation relative to the support stand.

These together with other objects of the invention, along with the various features of novelty which characterize the invention, are pointed out with particularity in the claims annexed to and forming a part of this disclosure. For a better understanding of the invention, its operation advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side orthographic view of the instant invention in an extended condition.

DESCRIPTION OF THE PREFERRED EMBODIMENT

Figure 1:
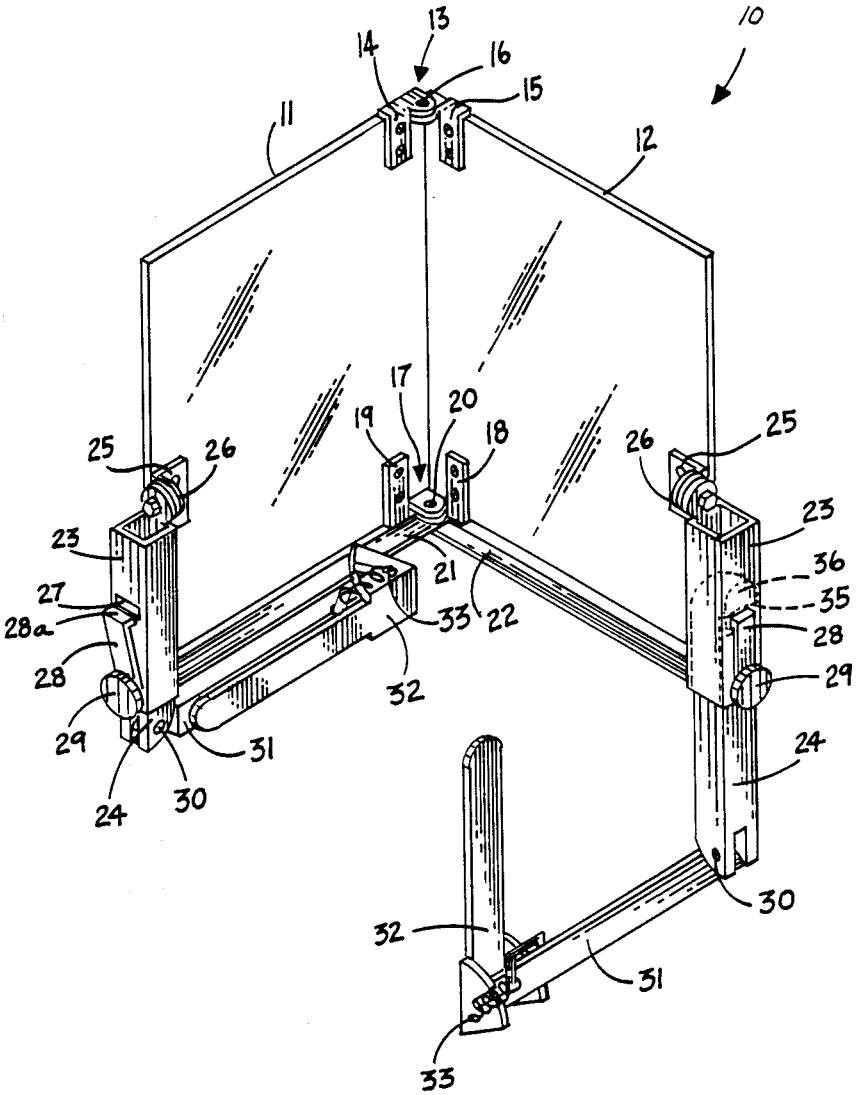
FIG. 1 is an isometric illustration of the instant invention in a partially interfolded condition.
Figure 1:
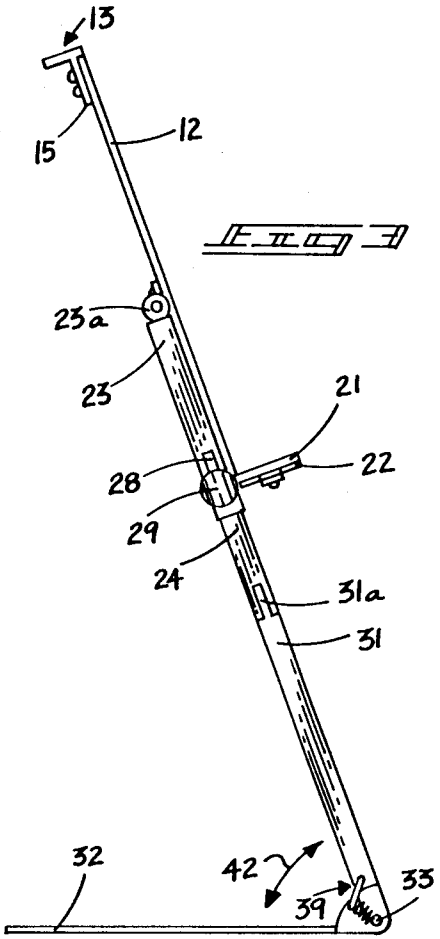

With reference now to the drawings, and in particular to FIG. 1 thereof, a new and improved reading material support stand embodying the principles and concepts of the present invention and generally designated by the reference numeral 10 will be described.

More specifically, it will be noted that the reading material support stand 10 essentially comprises a first transparent support surface 11 hingedly secured to a second transparent support surface 12. A top support hinge 13 secured to top edges of the respective first and second support surfaces 11 and 12 and a bottom support hinge 17 secured to lower terminal edges of the respective support surfaces 11 and 12 hingedly secure the two support surfaces together wherein top support hinge 13 includes a right "L" shaped attachment bracket securable to the first transparent support surface with a left "L" shaped attachment bracket 15 secured to the second transparent support surface, as illustrated in detail in FIG. 5. Right "L" shaped attachment bracket 14 has integrally secured thereto a pivot boss **14*a* aligned with the short leg of the right "L" shaped attachment bracket where a left pivot boss 15*a* secured to the left "L" shaped attachment bracket 15 is positioned underlying the short leg of the "L" shaped attachment bracket 15 to enable pivot boss 14*a* to rotatably slide over the left pivot boss 15*a* by means of the top hinge pivot 16. A free edge 114 of the right pivot boss 14*a* may thereby come into contact with abutment surface 115 of the short leg of "L" shaped attachment bracket 15 to prevent over-centering of first transparent support surface 11 with respect to the second transparent support surface 12 and accordingly enable linear alignment of the two support surfaces 11 and 12 in a single plane, as illustrated in FIG. 3** for example.

Figure 4:
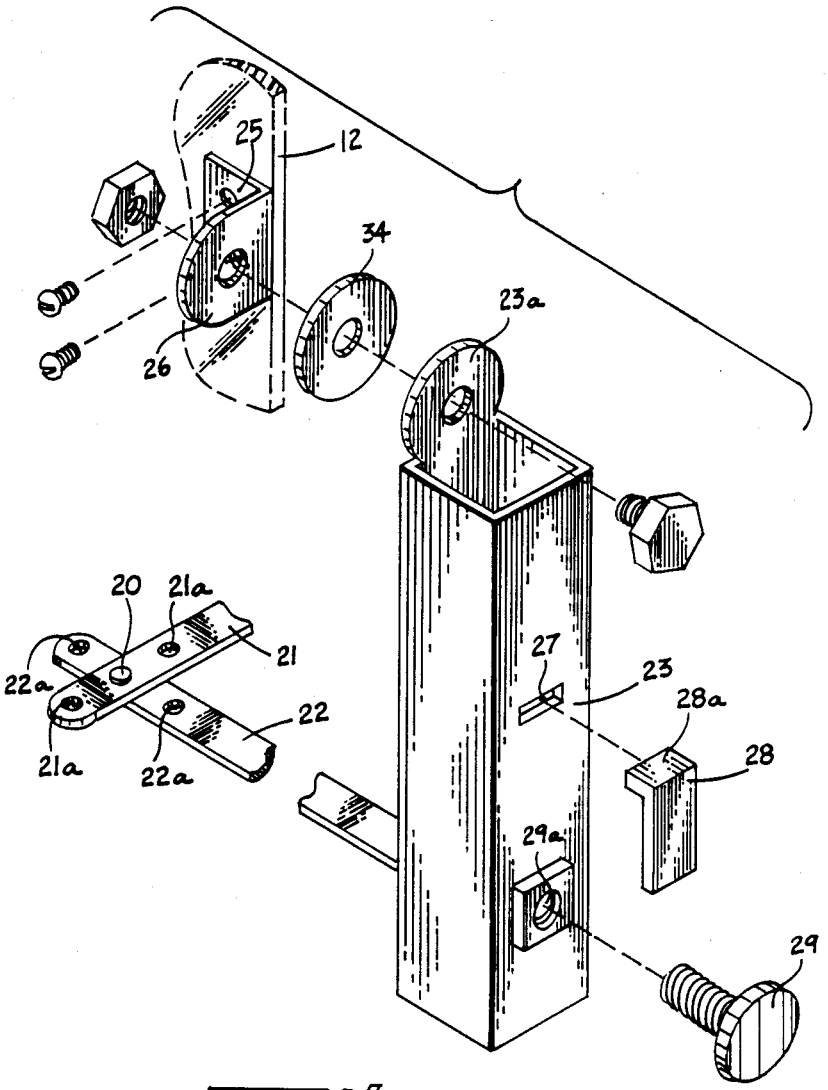
FIG. 4 is a isometric exploded view of a tubular support surface frame member utilized by the instant invention.
Figure 5:
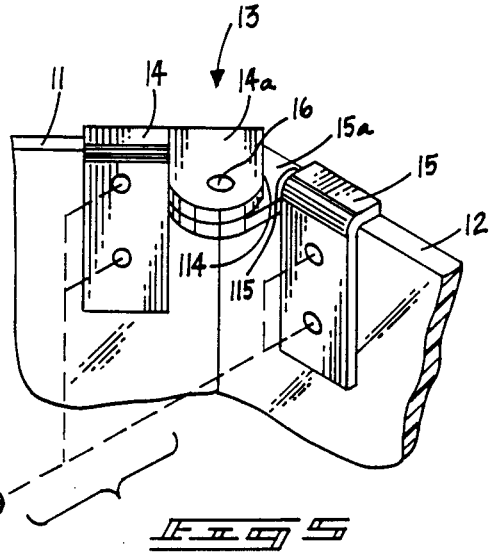
FIG. 5 is an isometric illustration of the top support hinge member of the instant invention somewhat enlarged.

The bottom support hinge 17 is similar in construction to the top support hinge 13 wherein a left "L" shaped attachment bracket is secured to support surface 11 and a right "L" shaped attachment is secured to the second transparent support 12 in a manner similar to that that as illustrated in FIG. 5 wherein additionally the bottom hinge pivot pin 20 axially aligned with top hinge pivot 16 extends beyond the surfaces of the associated pivot bosses, as illustrated in FIG. 4, to project through the left shelf 21 and right shelf 22, as illustrated in FIG. 4.

Secured to outside lateral edges of the support surfaces 11 and 12 are tubular support surface frame members 23 each accepting a telescoping leg 24 and wherein the frame members 23 are secured to the support surfaces 11 and 12 by "L" shaped frame member brackets 25 formed with an integral orthogonal attachment boss 26 accepting a securement element to secure the respective frame members 23 to respective frame member brackets 25.

Each frame member 23 has formed therein a slot 27 extending generally orthogonal to the axial center line of each tubular frame member 23 to accept a projection **28*a* orthogonally and integrally part of a capture bracket 28 securedly positioned within each respective slot 27 by a threaded plug 29 interfitting within a threaded aperture 29*a*, as illustrated in FIG. 4**.

FIGS. 1, 2, 3 and 6 illustrate a first pivot 30 formed through a lowermost portion of a plurality of bifurcated legs of the respective telescoping leg 24 slidingly received within each respective tubular frame member 23.

Figure 2:
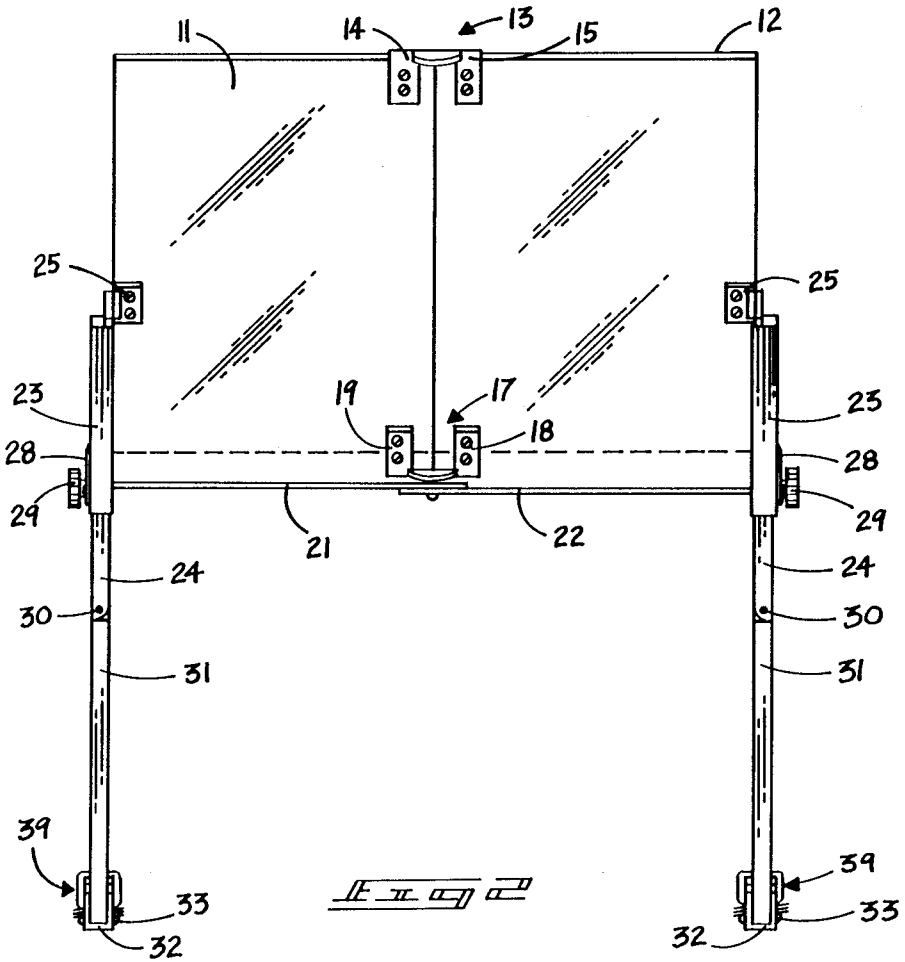
FIG. 2 is an orthographic view taken in elevation of the instant invention in an extended orientation.
Figure 6:
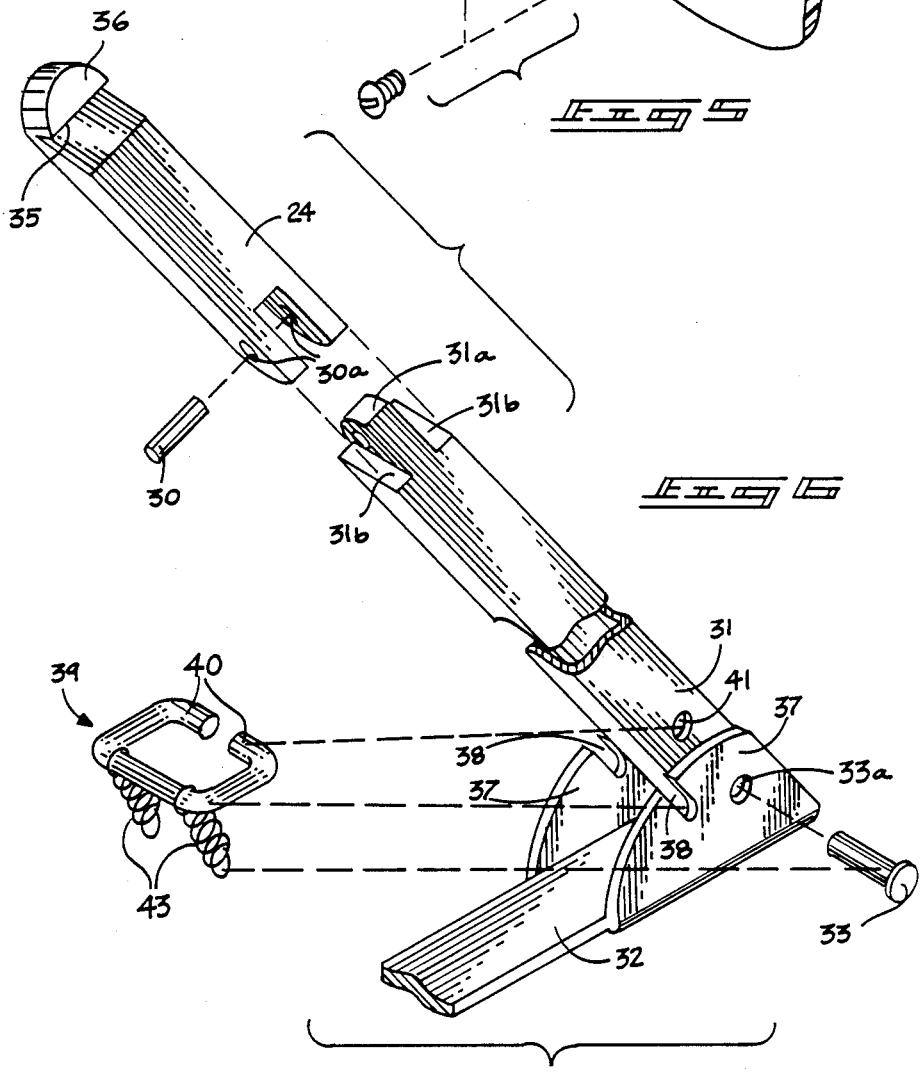
FIG. 6 is an isometric illustration somewhat enlarged illustrating the telescoping leg, support leg, and support foot utilized by the instant invention.

The respective first pivots 30 pivotally secure a support leg 31 formed with a locking lug 31*a*, as illustrated in FIG. 6, projecting upwardly from inclined ramp surfaces 31*b* that engage with lower surfaces of the aforenoted bifurcated legs of the telescoping leg 24 to maintain a linear alignment of a telescoping leg 24 with a support leg 31, as illustrated in FIGS. 2, 3 and 6.

A support foot 32 is pivotally secured to each support leg 31 by a second pivot pin 33 rotatably accepted within second pivot apertures 33*a* within arcuate upstanding flanges 37 orthogonally and integrally formed to outer terminal edges of the respective support feet 32, as illustrated in detail in FIG. 6. A locking slot 38 is formed in each of the arcuate upstanding flanges 37 and is generally orthogonal to the radius of curvature of each flange 37 to accept a locking ring 39 formed with pivot legs 40 rotatably acceptable within pivot leg bores 41 positioned within the support legs 31 above the height of the respective arcuate upstanding flanges 37 wherein in a locked position, the locking ring 39 is accepted within the respective locking slots 38 of the flanges 37 to secure the respective support feet 32 at a position angle 42, as illustrated in FIG. 3, of approximately 70 degrees to provide a convenient orientation of the support surfaces 11 and 12 as a support reading material thereon with respect to a user thereof. The position angle 42 may in fact range from 60 degrees to 80 degrees between a respective support foot 32 and a support leg 31 but wherein 70 degrees is deemed to be optimum. It is further noted that each lock ring 39 has secured thereto a plurality of positioning springs 43 secured to each second pivot pin 33 to maintain the lock ring 39 either within the respective locking slots 38 or maintain the lock ring 39 against the arcuate surfaces of each upstanding flange 37 to enable effective securement of the lock ring 39 within the locking slots 38 when desired.

Further reference to FIG. 6 will illustrate a locking notch 35 formed underlying a respective lock head of telescoping leg 24 wherein, as illustrated in FIG. 1, each respective capture bracket projecting through a respective slot 27 by means of projection 28*a* is positioned within each locking notch 35 to maintain the center position of the telescoping leg 24, as illustrated in FIG. 1.

When interfolding of the apparatus is desired, reference to FIG. 1 will illustrate the threaded plug 29 rotated to remove the respective projection 28*a* from its companion slot 27 whereupon telescoping leg 24 may be received within each tubular support surface frame member 23, and further each support leg 31 may be pivoted orthogonally to each telescoping leg 24 about the respective first pivot pin 30 and upon removing lock ring 39 from companion locking slots 38 enables a respective support foot 32 to be pivoted parallel against an overlying irrespective support leg 31 enabling a compact interfolding of the apparatus.

Reference to FIG. 4 illustrates the left shelf 21 and right shelf 22 pivoted through the bottom hinge pivot pin 20 whereupon the respective shelves 20 and 21 may be locked in an aligned orientation by means of the right shelf projections 22*a* being accepted within the left shelf 21*a* into an orientation, as illustrated in FIG. 2 and 3, to supportingly accept reading material thereon.

Further with reference to FIG. 4, aperture flanges 23*a* formed onto an interior wall of each respective tubular support frame member 23 has an aperture formed therein cooperating with a washer 34 to enable securement of each respective frame member 23 to each orthogonal attachment boss 26 by the use of conventional fasteners, as illustrated in FIG. 4. Furthermore, it is noted in FIGS. 4 and 5 that conventional threaded screws attach the respective brackets to the first and second support surfaces 11 and 12 wherein alternative securement means, such as adhesives, may be utilized. With further reference to FIG. 2 and FIG. 4, it should be noted that the respective left and right shelves 21 and 22 attach at their terminal ends remote from their pivotal association with bottom hinge piot 20 and are integrally secured to the tubular support surface frame members 23 thereby providing a rigid framework for securement of the respective transparent support surfaces 11 and 12.

As to the manner of usage and operation of the present invention, the same should be apparent from the above description. Accordingly no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reading material support stand comprising, a transparent support surface means for supporting reading material thereon; and a framework for said support surface means including a plurality of tubular frame members secured to said support surface means at opposed terminal sides thereof, and a plurality of telescoping leg members each slidingly retractable and extensible within each of said tubular frame members, and a support leg pivotally securable to each of said telescoping leg members, and a support foot pivotally securable to each support leg for support of said reading material support stand on a support surface wherein the reading material support stand is interfoldable by each said support foot pivotal to a contiguous parallel orientation relative to each support leg, and each support leg pivotally foldable orthogonally relative to each tubular frame member, and wherein the transparent support surface means includes a first and second transparent support surface member each pivotal relative to the other by means of an upper and lower support hinge pivotally securing the first and second support surface member together, and wherein the lower support hinge includes an extended pivot extending through a left and right shelf spanning a distance between the plurality of tubular frame members wherein each shelf is integrally secured to each of said frame members at one end and pivotally secured to one another proximate their other ends permitting interfolding of the left and right shelf upon interfolding of the first and second transparent support members.

2. A reading material support stand as set forth in claim 1 wherein the left shelf includes a plurality of openings positioned on either side of said pivot cooperating with a plurality of projections on the right shelf to lock the right and left shelf in a linear orientation when the first and second transparent support surface members are in a linear orientation relative to each other.

3. A reading material support stand as set forth in claim 2 wherein each support foot is positionable into an open locked position relative to each support leg at an angle of approximately 70 degrees.

4. A reading material support stand as set forth in claim 3 wherein the upper and lower hinges are positioned along a common axis and orthogonal to a plane including a first pivot within each support leg pivotally securing each telescoping leg members thereto.

5. A reading material support stand as set forth in claim 4 wherein each support foot is provided with a second pivot pin oriented orthogonally to each of said first pivot securing each of said support legs relative to each of said telescoping leg members.

6. A reading material support stand as set forth in claim 5 wherein each telescoping leg member is provided with a notch cooperating with a detent selectively and operatively secured to each of said tubular frame members.

7. A reading material support stand as set forth in claim 6 wherein each telescoping leg member is formed with a bifurcated pair of legs accepting the pivotal connection to each support leg wherein each support leg is formed with an integral locking lug extending between the bifurcated legs and formed wtih an inclined ramp on either side of the locking lug to engage the bifurcated legs to prevent overcentering of the support legs relative to the telescoping leg.

8. A reading material support stand as set forth in claim 7 wherein each support foot includes a plurality of arcuate upstanding flanges including each of the second pivot pins further including a lock ring pivotally securable to each of the support legs and resiliently cooperating with each plurality of the arcuate upstanding flanges to engage a locking slot within the flanges to lock each of the support legs relative to each of the support feet.

9. A reading material support stand as set forth in claim 8 wherein each of the tubular frame members includes an apertured flange accepting a securement means to engage a boss element of a pair of "L" shaped frame members to secure each of the tubular frame members to each of the "L" shaped frame members wherein further each "L" shaped frame member is integrally secured to each of the first and second transparent support surface members.

* * * * *